US008618392B2

(12) United States Patent
Korfker

(10) Patent No.: US 8,618,392 B2
(45) Date of Patent: Dec. 31, 2013

(54) ADAPTER PIECE

(75) Inventor: Berent Korfker, Amsterdam (NL)

(73) Assignee: Gustav Pirazzi & Comp. KG (DE)

( * ) Notice: Subject to any disclaimer, the term of this patent is extended or adjusted under 35 U.S.C. 154(b) by 355 days.

(21) Appl. No.: 12/672,845

(22) PCT Filed: Aug. 6, 2008

(86) PCT No.: PCT/EP2008/006450

§ 371 (c)(1),
(2), (4) Date: Jul. 21, 2011

(87) PCT Pub. No.: WO2009/021657

PCT Pub. Date: Feb. 19, 2009

(65) Prior Publication Data

US 2012/0137853 A1 Jun. 7, 2012

(30) Foreign Application Priority Data

Aug. 10, 2007 (DE) ..... 10 2007 038 004

(51) Int. Cl.
*G10D 3/08* (2006.01)

(52) U.S. Cl.
USPC ..... 84/327

(58) Field of Classification Search
USPC ..... 84/274, 278–281
See application file for complete search history.

(56) References Cited

U.S. PATENT DOCUMENTS

| | | | | |
|---|---|---|---|---|
| 2,223,221 | A | 11/1940 | Miranda | |
| 3,479,916 | A * | 11/1969 | Wolf | 84/280 |
| 5,341,714 | A | 8/1994 | Roulet | |
| 2006/0174743 | A1 * | 8/2006 | Clemente | 84/279 |

FOREIGN PATENT DOCUMENTS

| | | |
|---|---|---|
| CH | 527479 A | 8/1972 |
| CN | 1764939 | 4/2006 |
| DE | 114285 C | 11/1900 |
| DE | 2009097 | 9/1970 |
| DE | 3021047 | 1/1981 |
| DE | 4137918 | 4/1992 |
| GB | 639350 | 6/1950 |
| JP | U S60-042906 | 3/1985 |
| JP | S60-084597 | 5/1985 |
| JP | U H02-053301 | 4/1990 |
| JP | 2004-502975 | 1/2004 |
| JP | 2006-065263 | 3/2006 |
| JP | 2006-514331 | 4/2006 |
| WO | WO 2006096867 | 9/2006 |

OTHER PUBLICATIONS

International Search Report issued by the European Patent Office on Jan. 14, 2010, for International Application No. PCT/EP2008/006450.
Written Opinion issued by the European Patent Office on Jan. 14, 2010, for International Application No. PCT/EP2008/006450.
International Preliminary Report on Patentability issued by the International Bureau on May 4, 2010, for International Application No. PCT/EP2008/006450.
Written Opinion of the International Search Authority issued by the International Bureau on May 4, 2010, for International Application No. PCT/EP2008/006450.

* cited by examiner

*Primary Examiner* — Kimberly Lockett
(74) *Attorney, Agent, or Firm* — Sheridan Ross P.C.

(57) ABSTRACT

An adapter piece (28) for fixing a shoulder rest (30) on a string instrument, having an adapter body (38) provided with at least four clamping fingers (32) engageable with a peripheral bottom edge (12) of the string instrument to be supported, shall keep the tonal impairment of the instrument particularly low, offering, at the same time, a high stability. For this purpose, at least two of the clamping fingers (32) are positioned such that they are engageable with the peripheral bottom edge (12) in the area of the outer blocks (20) of the string instrument.

4 Claims, 5 Drawing Sheets

ADAPTER PIECE

CROSS REFERENCE TO RELATED APPLICATIONS

This application is a national stage application under 35 U.S.C. 371 of PCT Application No. PCT/EP2008/006450 having an international filing date of 06 Aug. 2008, which designated the United States, which PCT application claimed the benefit of German Application No. 102007038004.8 filed 10 Aug. 2007, the entire disclosure of each of which are hereby incorporated herein by reference.

The invention related to an adapter piece for fixing a shoulder rest on a string instrument, having an adapter body provided with at least four clamping fingers engageable with a peripheral bottom edge of the string instrument to be supported.

BACKGROUND

String instruments, in particular violins and violas, are held, while being played, on their resonance-box end between the musician's chin and shoulder. As this causes, in the long run, for the musician a very uncomfortable position of the instrument, so-called chin rests and shoulder rests for violins and violas were developed.

These shoulder rests are detachably fixed, by means of a holding device, at the resonance box of the instrument and thus serve for making the holding of the instrument more comfortable for the musician. In general, a shoulder rest is fastened on a violin or the like, forming a support surface resting on the musician's shoulder, the instrument itself being supported on a selected level which depends on the musician's stature, in particular on the length of his or her neck.

Although numerous shoulder rests have been proposed and are available on the market, the types with a firm bottom, shaped according to the musician's shoulder, are preferred by a considerable part of the market. The underside of the firm bottom is usually provided with a pad resting against the musician's shoulder when the instrument is played. On the two ends of the bottom, holding elements or carrying elements rising upwards are mounted, which carry pivotable, forked end pieces. The latters can be fixed on the side walls of the resonance box of the instrument near the resonance-box bottom. To firmly fix this type of shoulder rest on the instrument, the bottom of the shoulder rest possesses a certain intrinisic elasticity serving for generating a certain clamping force with which the forked end pieces grasp the instrument. End pieces are also known in other embodiments in combination with the carrier elements, almost all of them, however, grasping the instrument with a certain clamping force.

To achieve a better adaption of the height level to the musician's neck, adapter pieces for shoulder rests have been developed. On the one hand, the shoulder rest is fixed to these adapter pieces, and on the other hand, the adapter piece is fastened to the instrument. Thus, the height of the instrument can be adapted by means of the adapter, to which shoulder rests of a simpler design, such as, for example, those with a simple flexible shoulder strap as shoulder support, can also be fixed.

These adapter pieces are often made of plastics or else of a lightweight metal, in order not to add too much weight. Such adapter pieces are in most cases fixed on the instrument, like the above-mentioned shoulder rests, by means of holding elements with end pieces, making use of certain clamping forces, near the bottom at the side of the resonance box of the instrument or at an angle over the edge of the resonance-box bottom. In most cases, such adapter pieces are braced in transverse direction relative to the longitudinal axis of the instrument at the widest spot of the resonance box or slightly diagonally to that spot.

The warpings which the adapter piece causes on the instrument are detrimental in this case because they result in a considerable impairment of the tonal quality. This is also valid for the so-called shoulder rests fixed through clamping forces. Furthermore, such a fixing of the adapter piece is not very stable, and when played in a very virtuoso way, the instrument tends to tilt or becomes partly detached from the holding elements. Adapter pieces from which the instrument will not be detached so easily are fixed under the resonance-box bottom almost over the entire surface, and their outer areas project over the resonance box of the instrument. This, however, hinders the musician in playing the instrument and, in addition, an adapter piece covering the entire surface considerably impairs the tonal quality of the instrument.

SUMMARY

Therefore, the invention is based on the task to provide an adapter piece of the above-mentioned type which offers a high stability and at the same time keeps the tonal impairment of the instrument particularly low.

This task is solved according to the invention by positioning at least two of the clamping fingers such that they are engageable with the peripheral bottom edge in the area of the outer blocks of the string instrument.

The invention is based on the idea that the tonal impairment of a string instrument can be kept low by adapting the mechanical contact of the adapter piece with the resonance box of the instrument specifically to the vibration behavior, because the impairment of the tonal purity and, therefore, the tonal quality of a string instrument results in particular from possible interventions into the vibration behavior. For taking the vibration behavior into account, one makes specific use of the knowledge that the resonance box of a string instrument possesses some spots where stiffeners of the resonance box are incorporated, so that there, vibration nodes tend to occur more frequently. At these stiffeners, the so-called blocks, the resonance box is, therefore, relatively vibration-insensitive to mechanical interventions and external contacts. Therefore, the adapter piece is designed for making the mechanical contact with the resonance box in these areas.

Advantageous embodiments of the invention are the subject matter of the dependent claims.

The positioning of the clamping fingers can be adapted to ergonomic or individual requirements. To achieve a particularly high stability of the adapter piece on the resonance box of the instrument, however, advantageously, two of the clamping fingers are positioned such that they are engageable with the peripheral bottom edge adjacent to the lower end block and on both sides thereof Through this symmetrical fixing, the vibration profile of the instrument is to a great extent taken into account.

Expediently, the adapter piece has an approximately horseshoe-shaped basic shape, the clamping fingers provided for the area of the outer blocks being fixed on the respective front end of the adapter body. Due to this horseshoe-shaped basic shape, the adapter body can be adapted, on the one hand, to the outer profile of the string instrument, and, on the other hand, only little material is required and, consequently, the weight is lower than in case of a design covering the entire surface. Furthermore, a good covering range and, therefore, a great stability are given, but unsightly projections as well as a certain bulkiness of the adapter body are also avoided.

Advantageously, the shape of the outer profiles of the adapter body is adapted to those of the instrument to be supported, in order to further use already existing shoulder rests without problems. Furthermore, the thickness of the adapter body is expediently approximately the same as the thickness of the peripheral bottom edge of the string instrument. Thus, conventional shoulder rests fit onto the adapter piece without problems and their holding elements can easily be fixed on the adapter body. Furthermore, an adapter body shaped in this way offers the advantage to avoid the above-mentioned unsightly projections and the bulkiness.

To offer the musician more freedom of movement and more comfort, the outer profile of the adapter body is advantageously provided, in the area corresponding to the lower end block of the string instrument to be supported, with a recess. This recess in the profile forms a clearance for the musician's clavicle. Thus, the adapter piece will not painfully press against the clavicle and will give the necessary freedom of movement which especially a solo performer requires when playing the instrument in a virtuoso way.

As string instruments are as a rule made of a special selected wood, which offers particularly good vibration and tonal properties, it is expedient to make the adapter piece from the same material. As the adapter piece covibrates when the string instrument is played, a particularly harmonic vibration behavior will be given in case of identical materials of adapter piece and resonance box. Usually, maple wood is used for the resonance box, which is also particularly suitable for manufacturing the adapter piece. The grain of the wood for the adapter piece should run in longitudinal direction of the instrument, to achieve a good bending behavior and also a good vibration behavior. Plastics suitable for instrument making, from which the adapter piece can be made, are also imaginable.

To avoid inadvertent damage, such as, for example, scratches in the varnish and/or even in the wood, when fixing the adapter piece on the resonance box of the instrument or removing it therefrom, it will be an advantage if the clamping fingers are provided on their inside with a protective lining. Preferably, this protective lining is designed as a felt lining, resulting in that felt guarantees very agreeable attenuation properties, so that the tonal quality of the string instrument is preserved. Other protective linings of the clamping fingers, such as, for example, foamed materials, textile fabrics or the like, can be used instead of felt.

It is expedient, in particular in view of fixing the clamping fingers on the resonance box and the resulting vibration behavior with regard to the tonal quality of the string instrument, to design the clamping fingers, at least those positioned in the area of the outer blocks, in such a way that their clamping hooks only grasp around the peripheral bottom edge, without touching the bottom or the wall of the resonance box. At these spots in the area of the outer blocks, a mechanical intervention has the least effects on the vibration behavior and guarantees a good tonal purity of the string instrument.

To be able to fix a plurality of different shoulder rests on the adapter piece, it is an advantage to provide means for fastening a shoulder rest on the adapter body. Such means can in the simplest way be holes for receiving setscrews, but also sleeves with locking screws integrally formed and/or attached onto the adapter body, to fix small spacing bars. Conventional shoulder rests with clamping devices can in this case easily be clamped onto the adapter body.

To adapt the height of the shoulder rest to the anatomy of the musician's neck, expediently a number of rotary wheels with setscrews arranged on both sides and provided each with contradirectional thread leads are fixed on the adapter piece, the setscrews engaging, on the one hand, into an associated threaded hole and/or thread in the adapter body and, on the other hand, into an associated thread in the shoulder rest. To mount the shoulder rest, the rotary wheel is rotated, and due to the contradirectional thread leads, the setscrews are tightened in both threaded holes. This brings about a very simple and firm, stable fastening and, at the same time, within certain limits, a height regulation of the shoulder rest.

The respective rotary wheel has expediently a diameter of minimally 15 mm to maximally 40 mm, to enable a sufficiently large contact surface of adapter piece and shoulder rest. A usual diameter can be in the range of 15 mm to 25 mm, to offer, on the one hand, sufficient clearance and to achieve, on the other hand, a good handlability of the rotary wheel. Thus, a bracing over the entire surface can be given, guaranteeing a good stability between shoulder rest and adapter piece.

The use of the adapter piece is particularly advantageous on string instruments, in particular on violins and violas, as the resonance box of these instruments is held between the musician's head and shoulder. However, a use on violoncellos is also imaginable, with the exception that in that case, instead of the shoulder rest, the spike for putting up the violoncello is fixed on the adapter piece.

The advantages achieved with the invention consist in particular in that an adapter piece for fixing a shoulder rest for string instruments with clamping fingers fixed in the area of the outer blocks of the resonance box of the instrument on the peripheral bottom edge, do not greatly influence the vibration behavior of the instrument, so that its high tonal quality is preserved. Furthermore, the shape of the adapter piece is adapted to the resonance box of the instrument and is easy to assembly and disassemble. In addition, the adapter piece guarantees a secure and comfortable holding of the string instrument and, at the same time, a high freedom of movement of the musician. Furthermore, a plurality of different shoulder rests, even already existing shoulder rests with clamping-element fixtures, can be fastened to the adapter piece.

DESCRIPTION OF THE FIGURES

An exemplary embodiment of the invention is explained in detail by means of a drawing in which.

Identical parts are marked with identical reference numbers in all figures.

DETAILED DESCRIPTION

Figure 1:
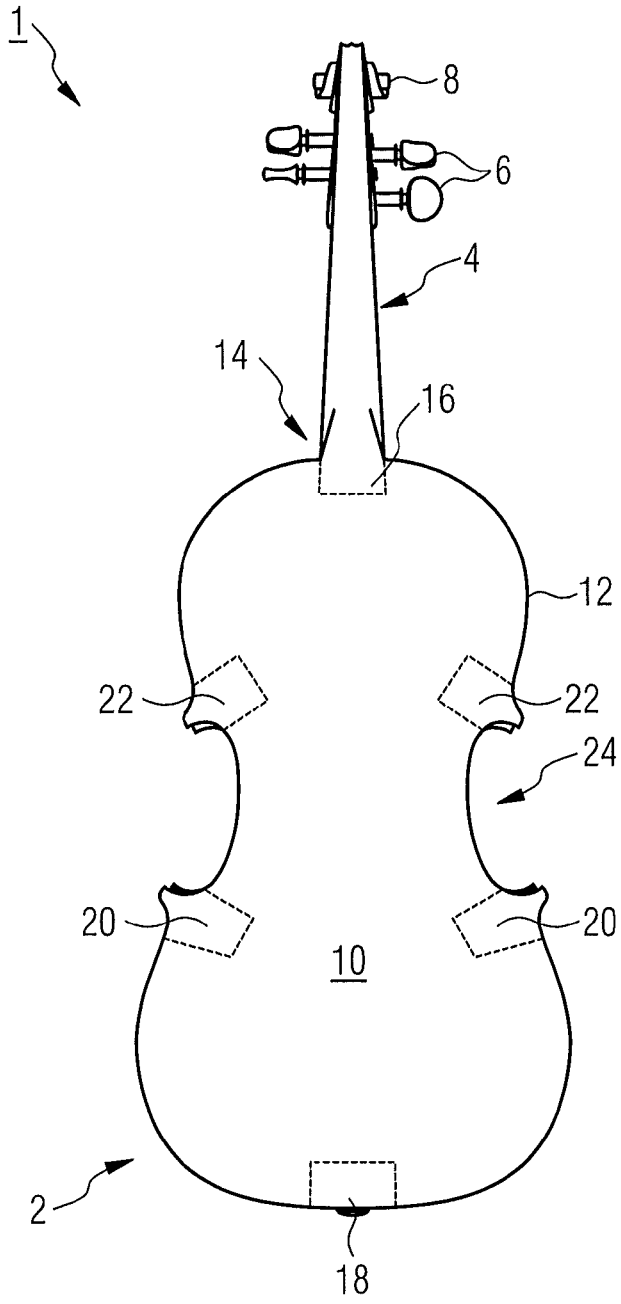
FIG. 1 is a bottom view of a classical violin with indication of the position of the blocks.

A classical violin 1 according to FIG. 1 comprises a resonance box 2 forming the resonance body, a neck 4, on which a fingerboard is fixed, and a pegbox with tuning pegs 6, ending in a scroll 8. The resonance box 2 includes a resonance-box bottom 10 as well as a peripheral bottom edge 12. On the neck-side end 14 of the resonance box 2, the neck 4 of the violin 1 is connected via the upper end block 16 with the resonance box 2. Other blocks, serving for stabilizing the violin 1, are incorporated in the resonance box 2 and, therefore, indicated here only in dotted lines, as these blocks are not visible from outside. These blocks comprise one lower end block 18 as well as, in most cases, four outer blocks 20, 22, arranged on the ends of the area of a lateral inward curvature 24 of the resonance box 2.

At the lower end block 18, the strings of the violin 1 are tightened by means of a tailpiece end on the top side of the violin 1. Therefore, the lower end block 18 is incorporated in the resonance box 2 in a very stable and firm manner. The upper end block 16, carrying the neck 4 and the fingerboard, is also incorporated in the resonance box 2 in a stable and firm manner. The upper end block 16 and the neck 4 are today in most cases manufactured separately and glued together, to fulfill the required carrying properties as well as tonal and vibration properties.

On the sides of the resonance-box bottom 10, in the area of the peripheral bottom edge 12, side walls, so-called ribs 26, are put up, and on these ribs 26, opposite of the resonance-box bottom, a resonance-box cover is fastened. These parts essentially form the resonance box 2, representing the resonance room of the violin 1, and are stabilized by means of the outer blocks 20, 22 and the upper and lower end blocks 16, 18.

Figure 2:
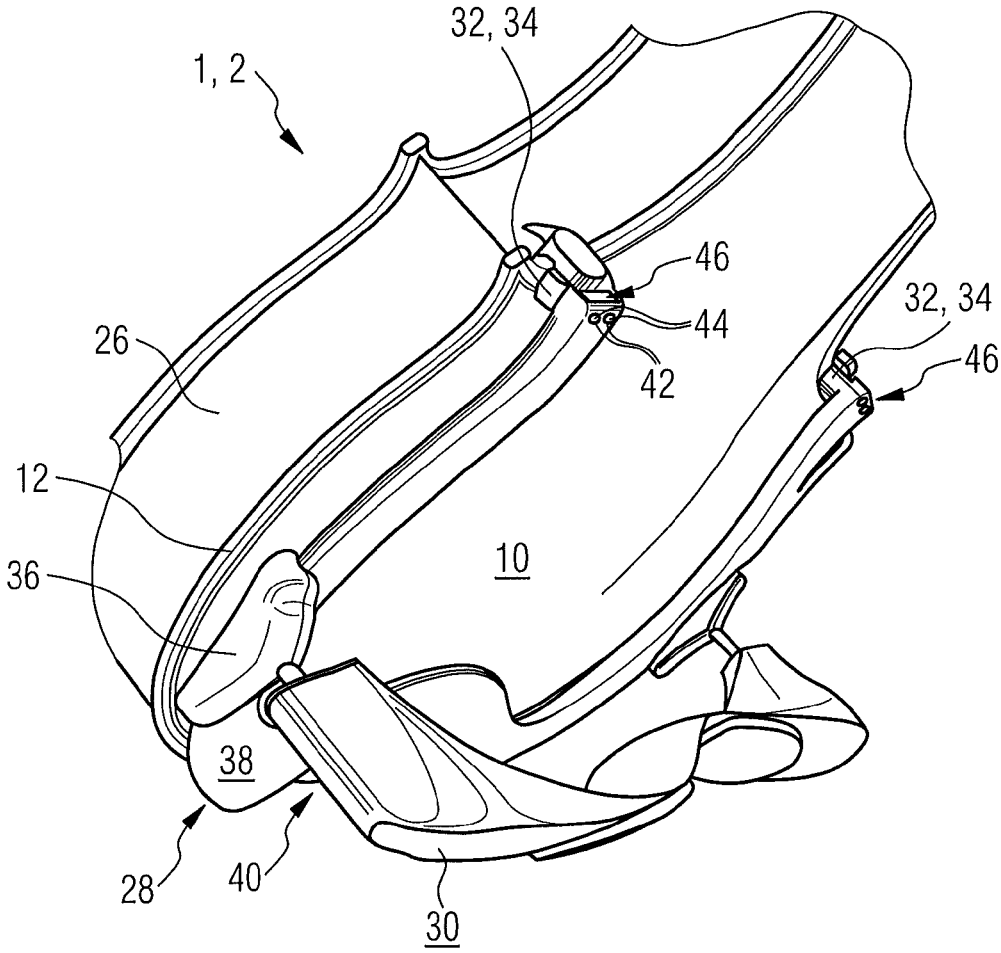
FIG. 2 is a perspective partial view of a violin with attached adapter piece and shoulder piece.
Figure 3:
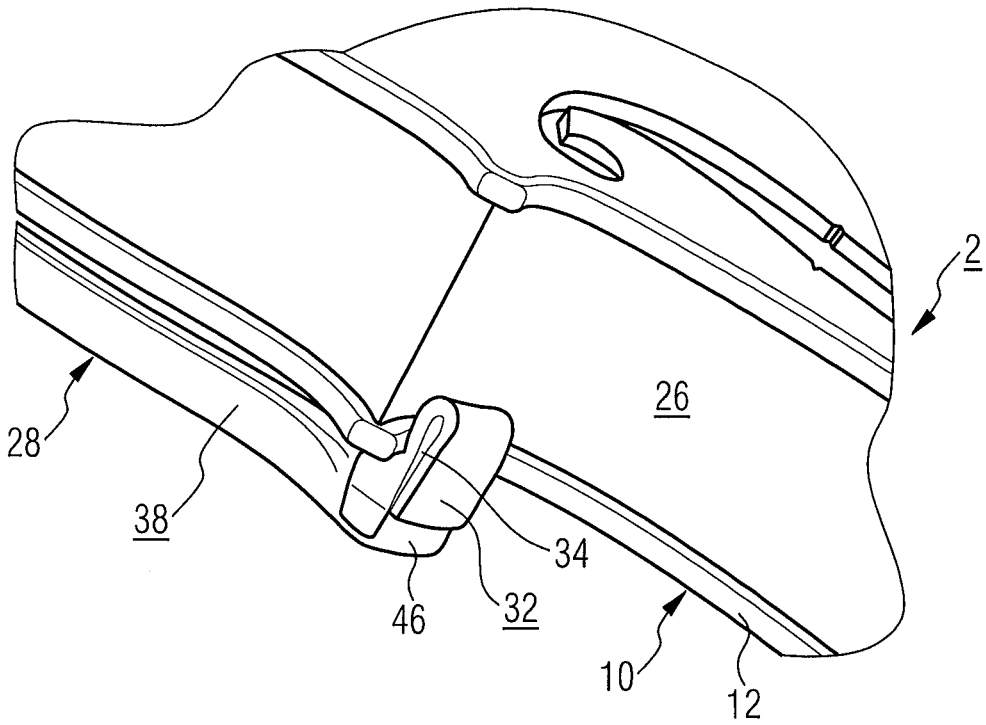
FIG. 3 is an enlarged detail of an area of an outer block with attached clamping finger from FIG. 2.

In order not to impair the tonal quality of the violin 1 through external mechanical interventions, but to offer the musician, nevertheless, a comfortable holding of the violin 1, an adapter piece 28, on which a shoulder rest 30 is fixed, is fixed by means of four clamping fingers 32 in vibration-insensitive areas of the resonance box 2. FIG. 2 shows that the clamping hooks 34 of the clamping fingers 32 only grasp the peripheral bottom edge 12 in the area of the outer blocks 20 and of the lower end block 18. FIG. 3 shows an enlarged view of the grasp of one of the clamping fingers 32 with one of the felt-coated clamping hook 34. One recognizes there that the felt-covered clamping hook 34 only grasps around the peripheral bottom edge 12, without touching the resonance-box bottom 10 or the rib 26. These areas of the outer block 20 as well as the area of the lower end block 18 tend to be vibration nodes more often and are, therefore, relatively insensitive to an external mechanical intervention.

The shoulder rest 30 fixed on the adapter piece 28 is a rest of conventional design, clamped onto the adapter body 38 with a separate clamping device 36. This shoulder rest 30 could also be clamped onto the violin 1 directly, without the adapter piece 28, but this would have the disadvantage that warpings of the resonance box 2 occur, impairing the tonal quality of the violin 1.

Figure 4:
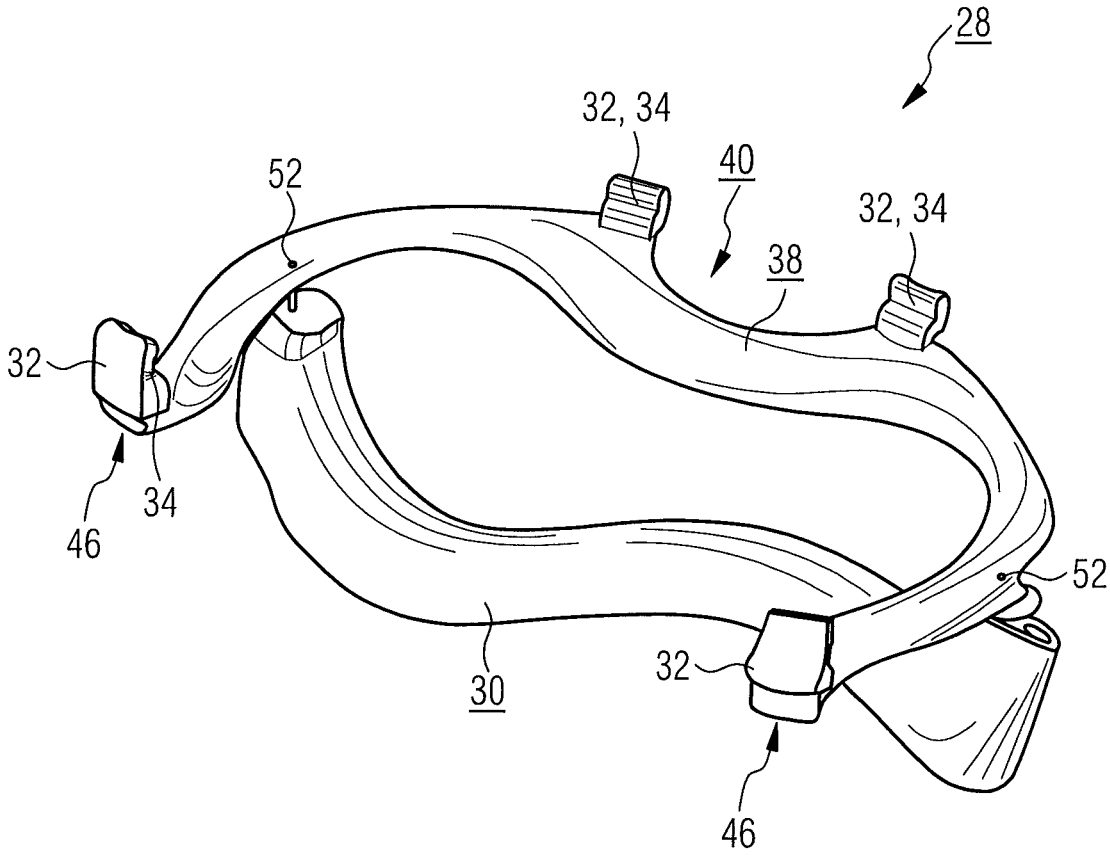
FIG. 4 is a perspective view of the adapter piece with shoulder rest from FIG. 2.

FIG. 4 shows that the adapter piece 28 has a kind of horseshoe shape, adapted to the outer profile of the violin 1. It is easy to recognize that there is a recess 40 in the area of the adapter body 38 corresponding to the lower end block 18. This recess 40 offers sufficient clearance for the musician's clavicle. Furthermore, it will be recognized that the adapter body 38 has approximately the same thickness as the peripheral bottom edge 10.

FIG. 2 shows clearly that the clamping fingers 32 with the clamping hooks 34 are variably adjustable in longitudinal direction, within certain limits. A kind of oblong eyelet 42 allows a certain adjustability of the clamping fingers 32, as the screws 44, with which the clamping fingers 32 are fixed on the adapter body 38, are fixed in a releasable manner. Once the clamping fingers 32 have been adjusted in a way adapted to the resonance-box bottom 10, or, in better words, to the peripheral bottom edge 12, of the violin 1, the screws 44 will be tightened again. Therefore, the clamping fingers 32 include inside a threaded adapter piece matching the screws 44. It is also imaginable to manufacture the adapter piece 28 in a simpler embodiment with firmly attached clamping fingers 32.

The arrangement of the clamping fingers 32 on the adapter body 38 is to a great extent symmetrical, so that two of the clamping fingers 32 are fixed on a front end 46 and the other two clamping fingers 32, symmetrically immediately next to the recess 40. Furthermore, the clamping hooks 34 are arranged such that in each case the grasping profiles of a clamping hook 34 on the front end 46 and of a clamping hook 34 next to the recess 40 are to a great extent opposite to each other. In this way, the violin 1 is protected against slipping in the adapter piece 28, even when played in a very virtuoso way.

Figure 5:
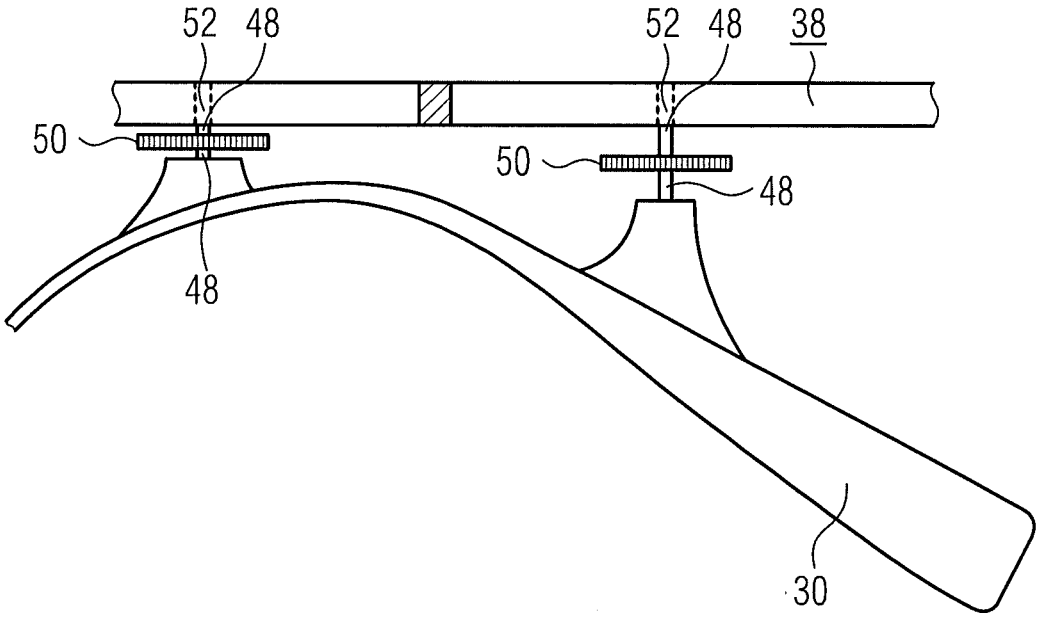
FIG. 5 is a partial view of an adapter body with screwed-on shoulder rest.

FIG. 5 shows that the shoulder rest 30 is screwed into the adapter body 38 by means of setscrews 48 and rotary wheels 50 with contradirectional internal thread leads. For this purpose, two threaded holes 52 are drilled into the adapter body 38. Alternatively to the threaded holes 52, threaded bushes can be fixed on the adapter body 38. The rotary wheels 50 serve for easy assembly and disassembly of the shoulder rest 30 on the adapter piece 28 and enable, by means of the setscrews 48, a certain height-level adjustment of the shoulder rest 30. Furthermore, the rotary wheels 50 with their diameter of 15 mm to 25 mm offer a sufficiently large contact surface and thus a good stability between adapter body 38 and shoulder rest 30.

The adapter piece 28 for the violin 1 represented in FIGS. 2 to 4 is just an exemplary embodiment. The adapter piece 28 can also be manufactured in a size suitable for violas as well as for violoncellos. In the latter case, a spike for putting up the instrument on the floor can be fixed instead of a shoulder rest 30. Furthermore, the shoulder rest 30 shown here is just one example of many to be fixed on the adapter piece 28. Furthermore, a chin rest can also be fixed on the adapter piece 28, either by screwing it into holes provided for that purpose or by means of holding clamps provided on the chin rest.

List of Reference Numbers

1 Violin
2 Resonance box
4 Neck
6 Tuning peg
8 Scroll
10 Resonance-box bottom
12 Bottom edge
14 Neck-side end
16 Upper end block
18 Lower end block
20, 22 Outer block
24 Curvature
26 Rib
28 Adapter piece
30 Shoulder rest
32 Clamping finger
34 Clamping hook
36 Clamping device
38 Adapter body
40 Recess
42 Eyelet
44 Screw
46 Front end
48 Setscrew
50 Rotary wheel
52 Threaded hole

The invention claimed is:

1. An adapter piece for fixing a shoulder rest on a string instrument, having an adapter body provided with at least four clamping fingers engageable with a peripheral bottom edge of the string instrument to be supported, at least two of the clamping fingers being positioned such that the at least two of the clamping fingers are engageable with a peripheral bottom edge in an area of outer blocks of the string instrument, wherein at least the clamping fingers positioned in an area of outer blocks of the string instrument to be supported are provided each with a clamping hook grasping only around the peripheral bottom edge.

2. An adapter piece for fixing a shoulder rest on a string instrument, having an adapter body provided with at least four clamping fingers engageable with a peripheral bottom edge of the string instrument to be supported, at least two of the clamping fingers being positioned such that the at least two of the clamping fingers are engageable with a peripheral bottom edge in an area of outer blocks of the string instrument the adapter body is provided with means for fixing a shoulder rest.

3. The adapter piece according to claim 2, wherein, for fixing the shoulder rest, a number of rotary wheels are provided, on both sides whereof setscrews are arranged, which are each provided with contradirectional thread leads.

4. The adapter piece according to claim 3, wherein each rotary wheel has a diameter of minimally 15 mm to maximally 40 mm.

* * * * *